United States Patent [19]

Steinberger

[11] Patent Number: 4,892,025

[45] Date of Patent: Jan. 9, 1989

[54] TREMOLO DEVICE HAVING AN ADJUSTABLE COUNTERSPRING AND LOCK

[75] Inventor: Ned Steinberger, Cornwall, N.Y.

[73] Assignee: Steinberger Sound Corporation, Newburgh, N.Y.

[21] Appl. No.: 223,095

[22] Filed: Jul. 22, 1988

[51] Int. Cl.[4] ..... G10D 3/12

[52] U.S. Cl. ..... 84/313

[58] Field of Search ..... 84/313

[56] References Cited

U.S. PATENT DOCUMENTS

| | | | |
|---|---|---|---|
| 3,162,083 | 12/1964 | Webster | 84/313 |
| 3,656,916 | 4/1987 | Gressett | 84/313 |
| 4,171,661 | 10/1979 | Rose | 84/313 |
| 4,475,432 | 10/1984 | Stroh | 84/314 N |
| 4,497,236 | 2/1985 | Rose | 84/298 |
| 4,549,461 | 10/1985 | Rose | 84/313 |
| 4,555,970 | 12/1985 | Rose | 84/313 |
| 4,632,004 | 12/1986 | Steinberger | 84/313 |
| 4,632,005 | 12/1986 | Steinberger | 84/313 |

FOREIGN PATENT DOCUMENTS

| | | | |
|---|---|---|---|
| 1280026 | 10/1968 | Fed. Rep. of Germany | 84/313 |
| 2546127 | 4/1977 | Fed. Rep. of Germany | 84/313 |
| 683531 | 2/1965 | Italy | 84/313 |

*Primary Examiner*—Lawrence R. Franklin

*Attorney, Agent, or Firm*—Finnegan, Henderson, Farabow, Garrett & Dunner

[57] ABSTRACT

A tremolo device for a stringed instrument has a tailpiece for anchoring and moving one end of the strings. The tailpiece pivots on a screw post which is attached to the body. A counterspring provides a force on the tailpiece which opposes the tension of the strings on the tailpiece. The counterspring is attached at a first end thereof to the body of the instrument and a second end thereof to the tailpiece. A screw received in and rotatable relative to the tailpiece is attached to the second end of the counterspring. Be rotating the screw, the distance from the tailpiece to the second end of the counterspring is varied, thereby varying the moment applied to the tailpiece by the force of the counterspring.

9 Claims, 3 Drawing Sheets

TREMOLO DEVICE HAVING AN ADJUSTABLE COUNTERSPRING AND LOCK

BACKGROUND OF THE INVENTION

1. Field of the Invention

The present invention relates to a tremolo device for a stringed instrument.

2. Description of the Prior Art

Tremolo devices have been used for many years with stringed musical instruments for creating a vibrato sound. Broadly, a tremolo device provides a means for changing the tension on all of the strings of an instrument simultaneously to create a pitch change during vibration of the strings. Typically, such tremolo devices include a moving tailpiece on the body of the stringed instrument that is utilized to accomplish this tension change. In such a device, a pivot point is established, and the tailpiece pivots about that point to vary the tension in the strings.

In some tremolo devices, the bridge is mounted on the pivoting tailpiece, to pivot with the tailpiece. In other tremolo devices, the bridge is mounted separate from the tailpiece and does not pivot with the tailpiece.

A handle or actuating arm is generally provided for facilitating the pivoting of the tailpiece, while the instrument is played. A counterspring is generally utilized to counteract the pull of the strings on the tailpiece. Examples of such tremolo devices include U.S. Pat. No. 4,171,661 to Rose, U.S. Pat. No. 4,549,461 to Rose and U.S. Pat. No. 4,632,004 to Steinberger.

FIG. 2 shows a conventional tremolo device with strings 26 mounted on a tailpiece 24. Tailpiece 24 includes upper plate 23 and lower plate 32 which depends from upper plate 23 into recess 33 in the body 40 of a guitar. By moving actuating arm 28, tailpiece 24 pivots on screw post 38 to vary the tension in the strings. Counterspring 30 counteracts the pull of the strings on tailpiece 24. One end of counterspring 30 is attached to the body 40 by spring anchor plate 42 and anchor screw 44. The other end of counterspring 30 is attached to lower plate 32 of tailpiece 24.

A concern in the design of tremolo devices has been setting the tremolo tailpiece at a selected equilibrium position in a convenient manner.

Accordingly, it is an object of this invention to provide a tremolo device with a tailpiece which can be set at a selected equilibrium position in a convenient manner and be adjusted quickly during play without the use of tools.

It is a further object of this invention to provide an arrangement for setting the tremolo tailpiece that can be retrofitted to an existing stringed instrument with minimum alteration.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided a tremolo device for a stringed instrument having a body and a plurality of strings. The tremolo device includes tailpiece means for anchoring and moving one end of the strings, pivot means for pivotally mounting the tailpiece means on the body, and counterspring means for providing a force on the tailpiece means which opposes tension of the strings on the tailpiece means. The tremolo device also includes means for attaching a first end of the counterspring means to the body, and means for attaching a second end of the counterspring means to the tailpiece means and for varying the distance from the tailpiece means to the second end of the counterspring means to vary the moment applied to the tailpiece means by the force of the counterspring means.

It is further preferable that the attaching and varying means includes a screw received in and rotatable relative to the tailpiece means and attached to the second end of the counterspring means, wherein the distance from the tailpiece means to the second end of the counterspring means is varied by rotating the screw.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DESCRIPTION OF THE PREFERRED EMBODIMENT

Reference will now be made in detail to the present preferred embodiment of the invention as illustrated in the accompanying drawings.

Figure 1:
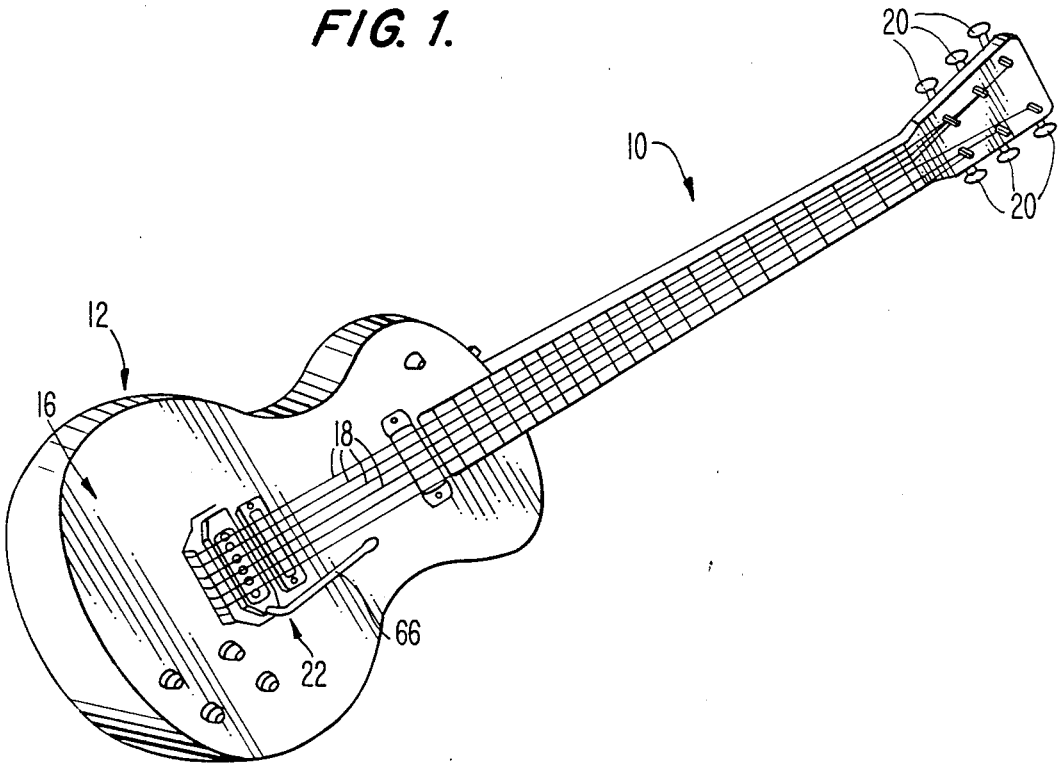
FIG. 1 is a perspective view showing a tremolo device on an electric guitar.
Figure 2:
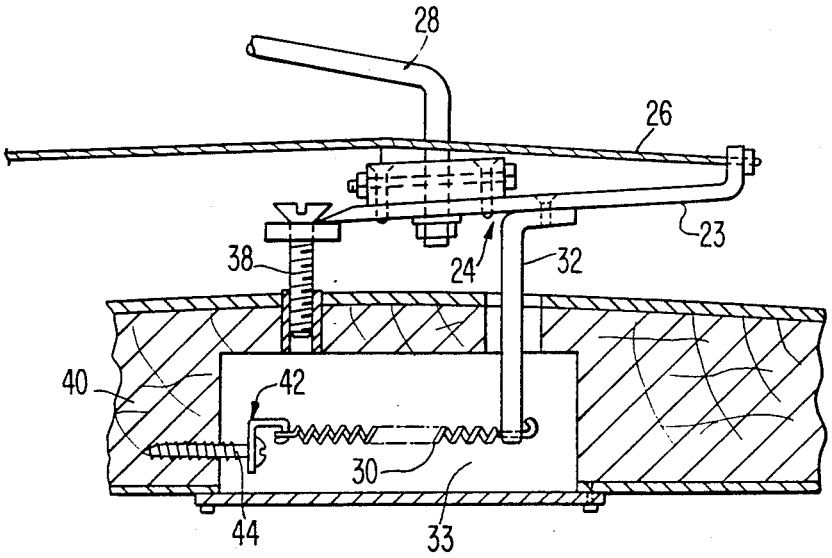
FIG. 2. (PRIOR ART)
FIG. 2 is an enlarged partial section of an electric guitar showing a conventional tremolo device.
Figure 4:
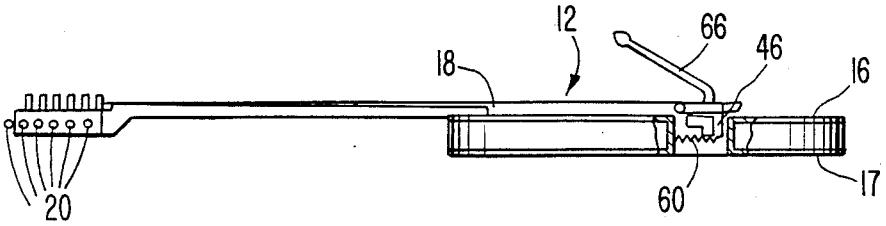
FIG. 4 is side view of the apparatus of FIG. 1.

In accordance with the present invention, there is provided a tremolo device for a stringed instrument having a body and a plurality of strings. As shown in FIGS. 1 and 4, the stringed instrument is a guitar 10 having a body 12. The body has a front side 16 and a rear side 17. A plurality of strings 18 are located on the front side 16 of the body. One end of each string 18 is connected to a respective tuning peg 20 for tuning the strings.

Figure 3:
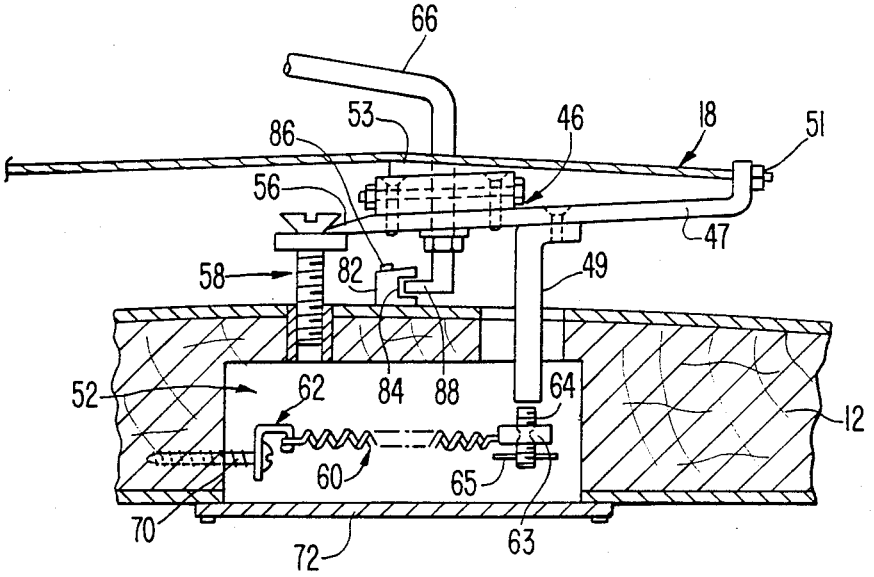
FIG. 3 is an enlarged partial section of an electric guitar incorporating the teachings of the present invention.

In accordance with the present invention, there is provided tailpiece means for anchoring and moving one end of the strings. As shown in FIG. 3, the tailpiece means includes a tailpiece 46 which includes an upper plate 47 and a lower plate 49 which depends from upper plate 47 into recess 52 in body 12 of the guitar. Upper plate 47 includes an anchor portion 51 for anchoring one end of the strings 18. Upper plate 47 further includes a bridge 53 for defining one end of the vibrating portion of the strings.

In accordance with the present invention, there is provided pivot means for pivotally mounting the bridge plate means on the body. As shown in FIG. 3, the pivot means includes screw post 58 which extends from body 12 of the guitar. The screw post 58 defines a pivot point for and engages a knife-edge portion 56 of upper plate 47 of tailpiece 46. Actuating arm 66 is connected to the upper plate 47, bridge 53 and string 18. Movement of the actuating arm 66 causes the tailpiece 46 to pivot on screw post 58, and thereby varies the tension of the strings to produce a tremolo effect.

Figure 5:
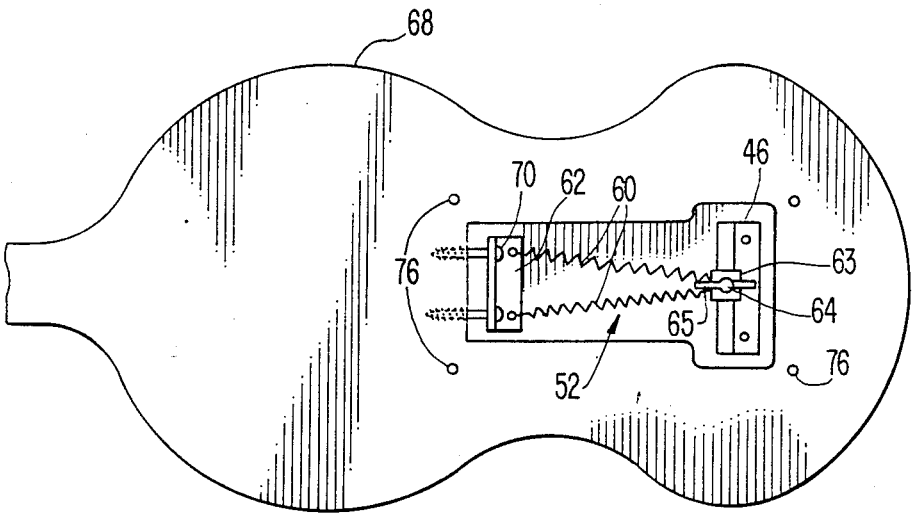
FIG. 5 is a partial rear view of the arrangement shown in FIG. 3 without a cover plate.

In accordance with the present invention, there is provided counterspring means for providing a force on the tailpiece means which opposes tension of the strings on the tailpiece means, and means for attaching a first end of the counterspring means to the body. As shown in FIGS. 3 and 5, the counterspring means includes a counterspring 60 which is in tension. The means for attaching a first end of the counterspring means to the body includes a spring anchor plate 62 and an anchor screw 70. Anchor screw 70 fastens the plate to the body 12 of the guitar.

In accordance with the present invention, there is provided a means for attaching a second end of the counterspring to the tailpiece means and varying the distance from the tailpiece means to the second end of the counterspring means to vary the moment applied to the tailpiece means by the force of the counterspring means. As shown in FIG. 3, the means for attaching and varying includes a screw 64 received in and rotatable relative to the lower plate 49. Screw 64 extends perpendicular to the plane of the strings 18.

It is preferable to provide means for attaching said screw to said counterspring means for allowing said screw to rotate relative to said second end of said counterspring means and for preventing said counterspring means from translating along the length of the screw. The means for attaching the screw to the counterspring means is collar 63 which rides in a groove on screw 64. Screw 64 rotates relative to collar 63 and the end of the counterspring 60. Screw 64 is threaded in lower plate 49 to vary the distance from the tailpiece 46 to the end of the counterspring 60 which is attached to the screw 64 by collar 63, when screw 64 is rotated. Screw 64 includes handle 65 for facilitating rotation of screw 64. Thus, as the screw 64 is rotated and moves toward the threaded lower plate 49, collar 63 and counterspring 60 moves toward lower plate 49 and the moment applied to the tailpiece 46 by the force of the counterspring 60 is reduced due to the reduction of the effective lever arm. On the other hand, as the screw is rotated away from lower plate 49, the moment applied to the tailpiece by the force of the counterspring is increased in a similar manner.

Figure 6:
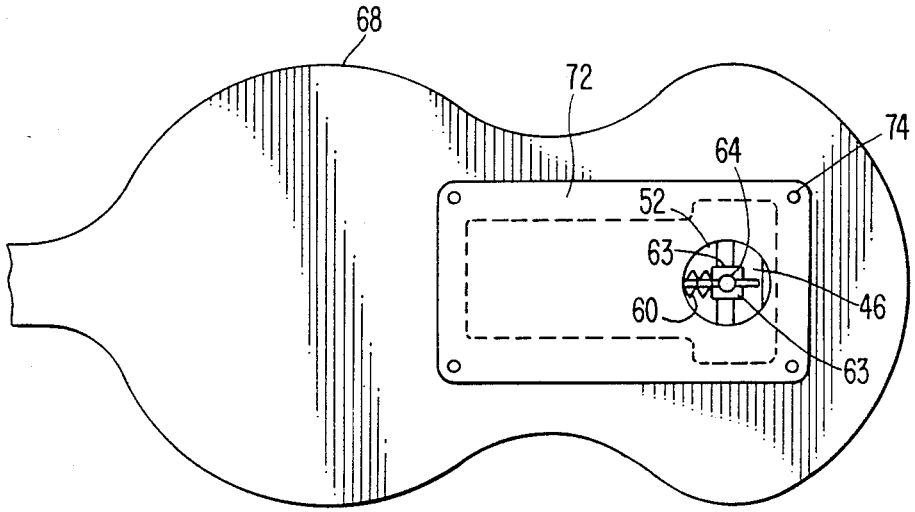
FIG. 6 is a partial rear view of the arrangement shown in FIG. 5 with a cover plate in place.

In accordance with the present invention, the screw is positioned and accessible for actuation on the rear side of the body. The screw 64 is located in a recess 52 in rear side 68 of the body 12. FIG. 5 shows the recess 52 with a first end of the counterspring 60 attached to the body 12 by spring anchor plate 62 and anchor screw 70. A second end of the counterspring 60 is attached to tailpiece 46 by collar 63 and screw 64. Recess 52 is covered by a cover 72. The cover 72 is attached to the rear side 68 of the body 12 by means of bolts 74 which are received in threaded apertures 76 as shown in FIGS. 5 and 6.

In accordance with the present invention, there is provided means for selectively locking the bridge plate means to the body and preventing the pivoting of the bridge plate means with respect to the body. It is preferable to provide a single actuating arm means both for actuating the tremolo by pivoting the tailpiece means relative to the body, and for actuating the locking means by selectively locating the tailpiece means to the body. As shown in FIG. 3, the locking means includes a tab 88 integral with actuating arm 66. Tab 88 mates with a slot 84 in housing 82. Housing 82 is attached to the body 12 by means of a lock mounting screw 86. By rotating actuating lever 66, tab 86 engages slot 84. The mating of the slot 84 and tab 88 effectively locks the tailpiece 46 to the body 12 of the guitar and prevents pivoting of the tailpiece 46 with respect to the body 12. Alternatively, the actuating arm for the tremolo may be separate from the actuating arm for the locking means.

Additional advantages and modifications will readily occur to those skilled in the art. The invention in its broader aspects is, therefore, not limited to the specific details, representative apparatus and illustrative example shown and described. Accordingly, departures may be made from such details without departing from the spirit or scope of the general inventive concept as defined by the appended claims and their equivalents.

What is claimed is:

1. A tremolo device for a stringed instrument having a body and a plurality of strings comprising:

tailpiece means for anchoring and moving one end of the strings;

pivot means for pivotally mounting said tailpiece means on the body;

counterspring means for providing a force on the tailpiece means which opposes tension of the strings on the tailpiece means, the counterspring means having a first end and a second end and extending in a first direction between the first end and the second end;

means for attaching the first end of the counterspring means to the body; and means for attaching the first end of the counterspring means to the tailpiece means and for varying the distance from the tailpiece means to the second end of the counterspring means by moving the second end of the counterspring means relative to the tailpiece means in a direction generally perpendicular to the first direction to vary the moment applied to the tailpiece means by the force of the counterspring means.

2. The tremolo device as claimed in claim 1, wherein the attaching and varying means includes a screw received in and rotatable relative to the tailpiece means and attached to the second end of the counterspring means, wherein the distance from the tailpiece means to the second end of the counterspring means is varied by rotating the screw.

3. The tremolo device as claimed in claim 2, wherein said screw is threaded in said tailpiece means.

4. The tremolo device as claimed in claim 2, including means for attaching said screw to said counterspring means for allowing said screw to rotate relative to said second end of said counterspring means and for preventing said counterspring means from translating along the length of the screw.

5. The tremolo device as claimed in claim 1, wherein the strings are located on a front side of the body and wherein the varying means is positioned and accessible for actuation on a rear side of the body opposite the front side of the body.

6. The tremolo device as claimed in claim 5, wherein the varying means is located in a recess in the rear side of the body.

7. The tremolo device as claimed in claim 1, wherein the strings define a plane and said screw extends perpendicular to the plane of said strings.

8. The tremolo device as claimed in claim 1, including means for selectively locking the tailpiece means to the body and preventing the pivoting of the bridge plate means with respect to the body.

9. The tremolo device as claimed in claim 8 including a single actuating arm means both for actuating the tremolo by pivoting the tailpiece means relative to the body, and for actuating the locking means by selectively locating the tailpiece means to the body.

* * * * *

UNITED STATES PATENT AND TRADEMARK OFFICE

CERTIFICATE OF CORRECTION

PATENT NO. : 4,892,025

DATED : January 9, 1990

INVENTOR(S) : Ned Steinberger

It is certified that error appears in the above-identified patent and that said Letters Patent is hereby corrected as shown below:

The date of the Patent on the cover sheet is changed from "January 9, 1989" to --January 9, 1990--.

Claim 1, column 4, line 37, "first" is changed to --second--.

Signed and Sealed this

Second Day of April, 1991

*Attest:*

HARRY F. MANBECK, JR.

*Attesting Officer*

*Commissioner of Patents and Trademarks*